US008317488B2

(12) United States Patent
Hartl

(10) Patent No.: US 8,317,488 B2
(45) Date of Patent: Nov. 27, 2012

(54) MULTI-CYLINDER, DRY-RUNNING PISTON COMPRESSOR A COOLING AIR FLOW

(75) Inventor: Michael Hartl, Unterhaching (DE)

(73) Assignee: Knorr-Bremse Systeme fur Schienenfahrzeuge GmbH, Munich (DE)

( * ) Notice: Subject to any disclaimer, the term of this patent is extended or adjusted under 35 U.S.C. 154(b) by 1159 days.

(21) Appl. No.: 12/064,870

(22) PCT Filed: Aug. 25, 2006

(86) PCT No.: PCT/EP2006/008340

§ 371 (c)(1),
(2), (4) Date: Jun. 30, 2008

(87) PCT Pub. No.: WO2007/022988

PCT Pub. Date: Mar. 1, 2007

(65) Prior Publication Data

US 2009/0016908 A1 Jan. 15, 2009

(30) Foreign Application Priority Data

Aug. 26, 2005 (DE) ..... 10 2005 040 495

(51) Int. Cl.
*F04B 39/06* (2006.01)

(52) U.S. Cl. ..... 417/309; 417/366; 417/440

(58) Field of Classification Search ..... 417/545, 417/502, 440, 307–308, 244, 254, 256, 257, 417/366

See application file for complete search history.

(56) References Cited

U.S. PATENT DOCUMENTS

| | | | | |
|---|---|---|---|---|
| 3,338,509 | A * | 8/1967 | McAninch | 417/242 |
| 6,183,211 | B1 * | 2/2001 | Wood | 417/254 |
| 6,698,405 | B2 * | 3/2004 | Bigi | 123/560 |
| 2002/0159896 | A1 * | 10/2002 | Finnamore et al. | 417/269 |
| 2005/0155562 | A1 * | 7/2005 | Taxon et al. | 123/41.86 |
| 2009/0155106 | A1 * | 6/2009 | Maloney et al. | 417/442 |

FOREIGN PATENT DOCUMENTS

| | | | |
|---|---|---|---|
| DE | 306576 | C | 6/1916 |
| DE | 1 403 963 | A1 | 11/1968 |
| DE | 101 38 070 | A1 | 2/2003 |
| FR | 1 108 479 | A1 | 7/1954 |
| FR | 01108479 | A1 * | 1/1956 |
| FR | 1 463 769 | A1 | 5/1963 |

* cited by examiner

*Primary Examiner* — Charles Freay
*Assistant Examiner* — Patrick Hamo
(74) *Attorney, Agent, or Firm* — Barnes & Thornburg LLP

(57) ABSTRACT

A multi-cylinder dry-running piston compressor for generating compressed air. The piston compressor includes a crankcase having an interior and a crankshaft rotatably mounted in the crankcase. Also included are two connecting rods mounted in the crankshaft and configured to run counter to one another. Further included are two cylinders mounted in the crankcase and a piston arranged at an end of each of the connecting rods and configured to run in a respective one of the two cylinders.

15 Claims, 1 Drawing Sheet

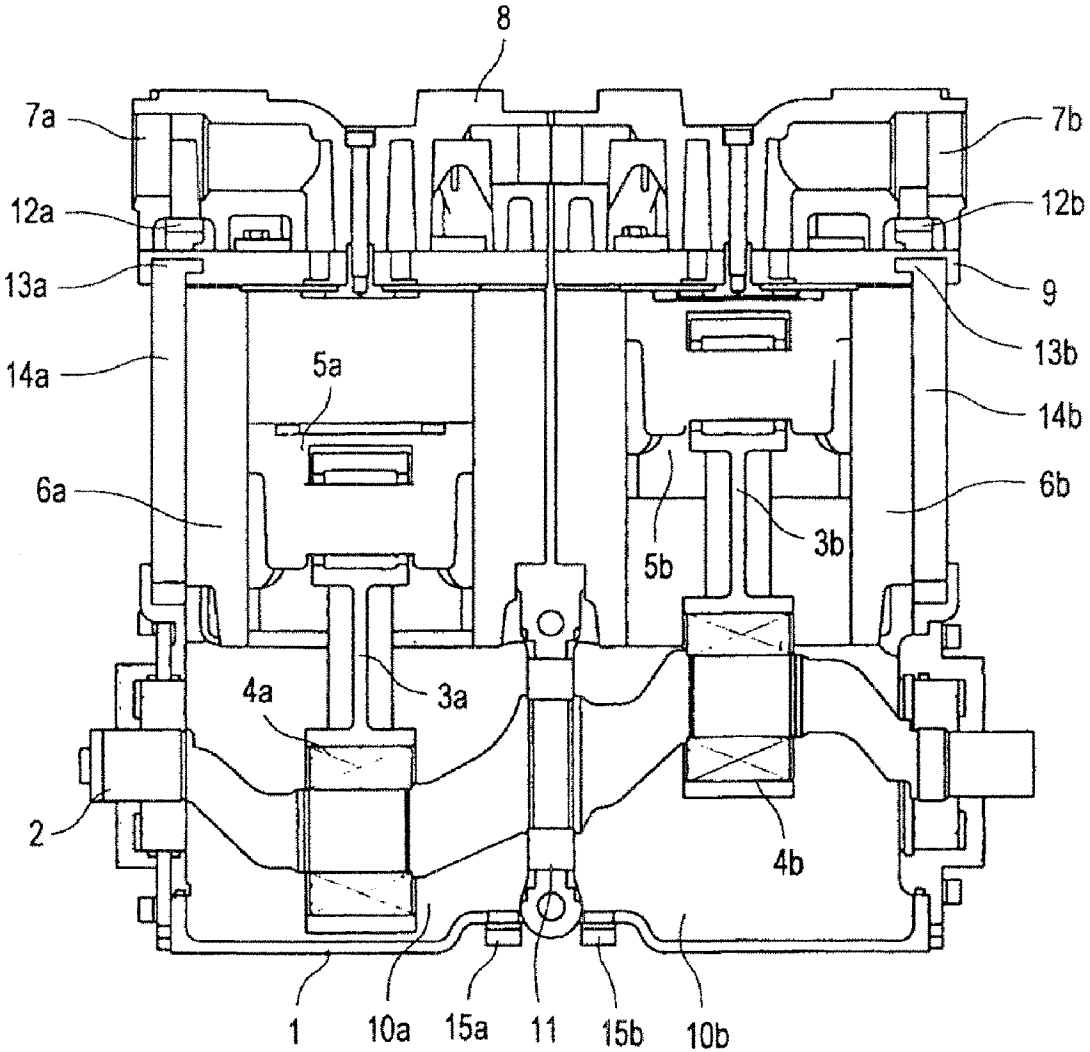
7b
12b
9
13b
14b
6b
3b
4b
5b
10b
15b
11
15a
10a
1
8
3a
5a
4a
7a
12a
13a
14a
6a
2

MULTI-CYLINDER, DRY-RUNNING PISTON COMPRESSOR A COOLING AIR FLOW

BACKGROUND AND SUMMARY

The present disclosure relates to a multi-cylinder dry-running piston compressor for generating compressed air. The piston compressor has a crankcase for rotatably mounting a crankshaft on which a number of connecting rods are rotatably mounted so as to run counter to one another. The number of connecting rods corresponds to the number of pistons with associated cylinders. Means is provided for generating a cooling air flow which passes through the interior of the crankcase as a result of a pumping effect caused by the movement cycle of the piston.

A piston compressor of the above type is used, for example, within a compressed air supply system of a utility vehicle or of a rail vehicle. When used in a utility vehicle, the compressed air generated by the piston compressor is also utilized for operating the air spring system, as well as for operating the brake system. On account of the associated very high compressed air demand, multi-stage piston compressors are usually used here, which are correspondingly of multi-cylinder design. With multi-cylinder piston compressors of the above type, the required compressed air demand can be generated within short periods of time.

In the past, oil-lubricated piston compressors were used in particular in utility vehicles. It has hitherto not been possible for oil-free, that is to say dry-running compressor concepts, to become widely established. That is, because of the high component temperatures, which result from a high rotational speed and power density in the smallest installation space, it has not been possible for the required component service life to be obtained.

In oil-lubricated piston compressors, the compressed air which is generated contains oil. The condensate which is precipitated during the drying of the air must, on account of the oil content, be collected in heatable containers and discharged and disposed of at regular intervals for environmental protection reasons. This leads to increased servicing expenditure. In addition to this, there are the frequently occurring problems of emulsion formation in the oil circuit of conventional oil-lubricated piston compressors in winter operation under low load. There are particular problems when using oil-lubricated piston compressors in utility vehicles. Directly-driven piston compressors, which are flange-mounted on the side of diesel engines, are operated with a high rotational speed and power density. That results in a high exchange of oil into the pneumatic system, which inevitably leads to the downstream components oiling up. In the extreme case, instances of coking can occur on account of high thermal loading, which instances of coking are carried by the compressed air into the pneumatic system and lead to the line cross sections becoming constricted, which causes damage to the downstream pneumatic devices. Dry-running piston compressors are of interest for all of the above reasons.

In general, dry-running piston compressors are known in which the intake air required for compression is conducted through the crankcase in order to hereby reduce the bearing temperatures. This, however, results in disadvantageous heating of the intake air, resulting in an increase in the compression end temperatures, as a result of which in turn the overall temperature level of the compressor is increased. Such a technical solution has therefore proven, in particular for thermally highly loaded single-stage compressors, to be unsuitable.

DE 101 38 070 A1 discloses a generic multi-cylinder dry-running piston compressor which is referenced here in the manner of a two-stage compressor. The compressor has a low-pressure stage with a large piston diameter and, connected downstream, a high-pressure stage with a small piston diameter. In the piston compressor, a pumping effect is generated by corresponding non-return valves as a result of the movement cycle of the piston. The pumping effect is utilized in order to generate a cooling air flow which passes through the crankcase. The cooling air flow is used primarily for cooling the jacket of the cylinder but also for ventilating the crankcase. A disadvantage is that the ventilation is not fully integrated into the piston compressor. Lateral cooling air supplies and additional filter systems for cleaning the cooling air are necessary in order to prevent the possibility of dirt and water collecting in the crankcase. It is, however, particularly disadvantageous that, in the case of an even number of pistons of equal diameter which move counter to one another, the pumping effect of the individual pistons in the crankcase is practically cancelled out.

The present disclosure relates to a multi-cylinder dry-running piston compressor configured such that a sufficient cooling air flow is generated even when there is an insufficient pumping effect as a result of oppositely-running pistons.

The present disclosure relates to a multi-cylinder dry-running piston compressor for generating compressed air. The piston compressor includes a crankcase having an interior, and a crankshaft rotatably mounted in the crankcase. Also included are two connecting rods mounted in the crankshaft and configured to run counter to one another. Further included are two cylinders mounted in the crankcase and a piston arranged at an end of each of the connecting rods and configured to run in a respective one of the two cylinders.

The present disclosure encompasses the technical teaching that, in order to assist the pumping effect, each piston operates in a separate chamber. The separate chambers are generated by separating means which are arranged in the crankcase and which surround the crankshaft, so that different pressure conditions are generated in the chambers.

An advantage of the piston compressor according to the present disclosure is that it is now possible, for example even in the case of piston compressors with two oppositely-running pistons of equal diameter, for a pumping effect for generating a cooling air flow to be created by the movement cycle. The separating means, which generates the chambers, need not separate the two chambers from one another in an absolutely pressure-tight manner. Slight overflow losses are entirely acceptable. As a result, it is possible to produce an environmentally-friendly dry-running piston compressor which has a high delivery capacity and whose temperature level remains subcritical. The multi-cylinder dry-running piston compressor, according to the present disclosure is, therefore, also suitable for being directly flange-mounted on the side of a diesel engine of a utility vehicle. The tightly restricted installation space available here has proven to be sufficient, since an extremely small design of a multi-cylinder dry-running piston compressor is possible on account of the solution according to the present disclosure.

It may be preferable, according to the present disclosure, for a sealed intermediate bearing, which is inserted into the crankcase, for the crankshaft to be provided as a separating means for forming the chambers assigned to the pistons. As well as serving as an additional bearing point for the crankshaft, the intermediate bearing may also ensure a sufficiently sealed separation between the chambers of the crankcase. It is also conceivable, according to the present disclosure, to use a dynamic radial sealing element, which is inserted into the crankcase instead of the intermediate bearing, to be used as a separating means. A radial sealing element can, of course, also be arranged in a positionally fixed manner on the crankshaft and provide dynamic sealing with respect to the crankcase.

At least one inlet valve, which may be embodied in the manner of a non-return valve, may be arranged in the region of the intake connecting pipe on the cylinder head for cooling the air. This is because, at this point, it is possible for filtered cooling air from the environment to be branched off to be measured, according to the present disclosure. It is additionally also possible for the inlet valve for the cooling air to be integrated into a valve plate, which is arranged adjacent to the cylinder head, with the compressor valves. In this case, it is possible to dispense with a separate valve plate for an inlet valve which is arranged in the cylinder head. This reduces the required number of parts.

An outlet valve, for the cooling air, which may be embodied in the manner of a non-return valve, is arranged on the underside of the crankcase. This is because, at this point, it is possible for the used, heated cooling air to be ejected in a suitable way to the environment. Both the inlet valve and outlet valves can be designed as robust lamellar valves.

According to the present disclosure, it is possible that the cooling air which is sucked in through the inlet valve is collected in a chamber of the valve plate and subsequently passes, via ducts which proceed from the chamber, into the crankcase. The ducts may be constructed or configured as externally situated tube lines in order to avoid heating of the cooling air as it passes the cylinder region. It is additionally conceivable to integrate the ducts into the wall of the cylinder in order to transport the cooling air from the region of the cylinder head into the associated chambers of the crankcase.

Other aspects of the present disclosure will become apparent from the following descriptions when considered in conjunction with the accompanying drawings.

BRIEF DESCRIPTION OF THE DRAWINGS

The FIGURE shows a longitudinal section through a twin-cylinder dry-running piston compressor having an internal cooling air flow, according to the present disclosure.

According to the FIGURE, a rotational movement generated by a drive unit (not shown) serves to drive a crankshaft 2 which is rotatably mounted in a crankcase 1. Connecting rods 3*a* and 3*b* are mounted adjacent to one another on the crankshaft 2 by interposed rolling bearings 4*a* and 4*b*. A piston 5*a* and 5*b* is arranged at an end of an associated connecting rod 3*a*, 3*b*, respectively, which is situated opposite the rolling bearings 4*a* and 4*b* of the associated connecting rod 3*a* and 3*b*. The two pistons 5*a*, 5*b* run in associated cylinders 6*a* and 6*b* and move in opposite directions corresponding to the cranking of the crankshaft 2. The two pistons 5*a* and 5*b* have an equal diameter.

Filtered ambient air is sucked in by the pistons 5*a* and 5*b* and passes via associated intake connecting pipes 7*a* and 7*b* into an interior of the compressor. The intake connecting pipes 7*a* and 7*b* are arranged on a cylinder head 8 of the piston compressor. A valve plate 9, which is situated between the cylinder head 8 and the cylinders 6*a* and 6*b*, has non-return valve arrangements (not shown) required for the compression of the ambient air.

The piston compressor has means for generating a cooling air flow which passes through the interior of the crankcase 1. The cooling air flow is generated by a movement cycle of the pistons 5*a* and 5*b*. In order to realize the pumping effect caused by this, each piston 5*a* and 5*b* operates in a separate chamber 10*a* and 10*b* in the crankcase 1. The chambers 10*a* and 10*b* are formed by a sealed intermediate bearing 11, which may also be a dynamic radial sealing element, which is inserted into the crankcase 1 as the separating means.

Each chamber 10*a* and 10*b* is assigned an inlet valve 12*a* and 12*b* for the cooling air in the region of the intake connecting pipe 7*a* and 7*b*. The inlet valves 12*a* and 12*b* are designed as lamellar valves. From here, the cooling air, which is sucked in, passes into a chamber 13*a* and 13*b* of the valve plate 9, and from here via external ducts 14*a* and 14*b* into the crankcase 1. That is to say, the air is sucked into the associated chambers 10*a* and 10*b*. The heated cooling air leaves the chambers 10*a* and 10*b* via associated outlet valves 15*a* and 15*b*. The outlet valves 15*a* and 15*b* are likewise designed as lamellar valves.

The present disclosure is not restricted to the exemplary embodiment described above. Modifications of the exemplary embodiment are conceivable in accordance with the present disclosure.

In accordance with the present disclosure, the piston compressor may be designed as a multi-stage piston compressor with at least one low-pressure stage and at least one subsequent high-pressure stage. The technical solution, or embodiments, according to the present disclosure, for improving the pumping effect can be used wherever even and/or odd numbers of pistons which move in opposite directions would, as a result of number, stroke or diameter, impede the generation of a sufficiently great internal cooling air flow.

According to the present disclosure, it may not be necessary to provide a separate inlet valve or outlet valve and separate cooling air ducts for every individual chamber which is generated by the separating means. By a corresponding branching of a common duct or by additional ducts, the number of required inlet valves and outlet valves can be reduced.

Although the present disclosure has been described and illustrated in detail, it is to be clearly understood that this is done by way of illustration and example only and is not to be taken by way of limitation. The scope of the present disclosure is to be limited only by the terms of the appended claims.

I claim:

1. A multi-cylinder dry-running piston compressor for generating compressed air, the piston compressor comprising:

a crankcase having an interior;

a crankshaft rotatably mounted in the crankcase;

two connecting rods mounted in the crankshaft and configured to run counter to one another;

two cylinders mounted in the crankcase;

a piston arranged at an end of each of the connecting rods and configured to run in a respective one of the two cylinders;

means for generating a cooling air flow which passes through the interior of the crankcase, the cooling air flow being a result of a pumping effect caused by a movement cycle of the pistons; and separating means for creating a separate piston chamber arranged in the crankcase for each piston to operate within, wherein the chambers surround the crankshaft to generate different pressure conditions in the chambers to assist in generating the cooling air flow from the pumping effect caused by the movement cycle of the pistons.

2. The multi-cylinder dry-running piston compressor as claimed in claim 1, wherein the separating means includes a sealed intermediate bearing, which is inserted into the crankcase.

3. The multi-cylinder dry-running piston compressor as claimed in claim 1, wherein the separating means includes a dynamic radial sealing element which is inserted into the crankcase.

4. The multi-cylinder dry-running piston compressor as claimed in claim 1, further including at least one inlet valve for the cooling air is arranged in a region of an intake connecting pipe on a cylinder head.

5. The multi-cylinder dry-running piston compressor as claimed in claim 1, further including at least one inlet valve for the cooling air that is integrated into a valve plate with compressor valves and which valve plate is arranged adjacent to a cylinder head.

6. The multi-cylinder dry-running piston compressor as claimed in claim 1, further including at least one outlet valve for the cooling air is arranged on an underside of the crankcase.

7. The multi-cylinder dry-running piston compressor as claimed in claim 4, wherein the at least one inlet valve is a lamellar valve.

8. The multi-cylinder dry-running piston compressor as claimed in claim 5, wherein the cooling air, which is sucked in through the at least one inlet valve, is collected in a chamber of the valve plate and subsequently passes, via ducts leading from the chamber, into the crankcase.

9. The multi-cylinder dry-running piston compressor as claimed in claim 8, wherein the ducts are configured as externally situated tube lines in order to avoid heating of the cooling air as it passes a region of the cylinder.

10. The multi-cylinder dry-running piston compressor as claimed in claim 1, wherein an even number of pistons are provided which move counter to one another in associated cylinders and the pistons have substantially identical diameters.

11. The multi-cylinder dry-running piston compressor as claimed in claim 1, wherein the piston compressor is a flange-mounted unit mounted on a side of a diesel engine of a utility vehicle.

12. The multi-cylinder dry-running piston compressor as claimed in claim 4, wherein the at least one inlet valve is a non-return valve.

13. The multi-cylinder dry-running piston compressor as claimed in claim 5, wherein the at least one inlet valve is a non-return valve.

14. The multi-cylinder dry-running piston compressor as claimed in claim 6, wherein the at least one outlet valve is a non-return valve.

15. The multi-cylinder dry-running piston compressor as claimed in claim 6, wherein the at least one outlet valve is a lamellar valve.

* * * * *